US008184138B2

(12) United States Patent
Beecher

(10) Patent No.: US 8,184,138 B2
(45) Date of Patent: May 22, 2012

(54) RIBBON GUIDE FOR THERMAL PRINTERS AND METHOD OF INSTALLATION

(75) Inventor: Charles D Beecher, Golden, CO (US)

(73) Assignee: Illinois Tool Works Inc., Glenview, IL (US)

( * ) Notice: Subject to any disclaimer, the term of this patent is extended or adjusted under 35 U.S.C. 154(b) by 572 days.

(21) Appl. No.: 12/365,720

(22) Filed: Feb. 4, 2009

(65) Prior Publication Data

US 2009/0262177 A1 Oct. 22, 2009

(51) Int. Cl.
*B41J 2/325* (2006.01)
*B41J 35/04* (2006.01)
*B41J 32/00* (2006.01)

(52) U.S. Cl. ..... 347/214; 400/248; 400/248.1; 400/250

(58) Field of Classification Search ..... 347/214; 400/242, 246, 247, 248, 248.1, 249, 250
See application file for complete search history.

(56) References Cited

U.S. PATENT DOCUMENTS

| | | | | |
|---|---|---|---|---|
| 4,840,502 | A * | 6/1989 | Grey | 400/196 |
| 4,998,834 | A | 3/1991 | Taylor | |
| 5,100,250 | A | 3/1992 | Suzuki et al. | |
| 5,110,228 | A | 5/1992 | Yokomizo | |
| 5,372,439 | A | 12/1994 | Poole et al. | |
| 5,399,035 | A | 3/1995 | Nakae | |
| 5,537,135 | A | 7/1996 | Hevenor et al. | |
| 5,727,887 | A | 3/1998 | Webster et al. | |
| 5,885,015 | A * | 3/1999 | No et al. | 400/247 |
| 5,961,229 | A | 10/1999 | Kameyama | |
| 6,057,870 | A | 5/2000 | Monnier et al. | |
| 6,195,111 | B1 | 2/2001 | Nelson et al. | |
| 6,226,026 | B1 | 5/2001 | Suzuki | |

(Continued)

FOREIGN PATENT DOCUMENTS

EP 0471471 A2 2/1992

(Continued)

OTHER PUBLICATIONS

EPO Communication dated May 27, 2011 transmittal of European Search Report with Search Opinion in Application No. 09156488.0.

(Continued)

*Primary Examiner* — Daniel Petkovsek
(74) *Attorney, Agent, or Firm* — Perry Hoffman

(57) ABSTRACT

A ribbon guide used to install a thermal ribbon in a thermal printer, the ribbon guide having a bottle shaped profile and being formed of V-Max® brand synthetic paper. The ribbon guide has three integral portions, a first portion having a cross-shaped slit and a hole, a second portion that may be used for gripping by an operator, and a third portion for receiving printed advertising and/or other useful information. The cross-shaped slit receives the very thin thermal ribbon and allows the ribbon guide to connect and hold the thermal ribbon during installation of the thermal ribbon in the thermal printer. After loading a reel of thermal ribbon onto a supply spindle and connecting the thermal ribbon to the ribbon guide, an operator may grip the second portion of the ribbon guide, and thread the ribbon guide through the internal mechanisms of the thermal printer including passed a print head to a reel on a take-up spindle. Using the ribbon guide reduces thermal ribbon handling by an operator. The ribbon guide may also be used as an advertising platform and as a helpful tool.

9 Claims, 4 Drawing Sheets

U.S. PATENT DOCUMENTS

| | | | | |
|---|---|---|---|---|
| 6,388,693 | B1 | 5/2002 | Loos | |
| 2007/0025790 | A1 * | 2/2007 | Lin | 400/208 |

FOREIGN PATENT DOCUMENTS

| | | | |
|---|---|---|---|
| GB | 769412 | A | 3/1957 |
| GB | 841947 | A | 7/1960 |
| JP | 2007-76548 | A | 3/2000 |

OTHER PUBLICATIONS

May 27, 2011 European Search Report in Application No. 09156488.0.

May 27, 2011 European Search Opinion in Application No. 09156488.0.

* cited by examiner

RIBBON GUIDE FOR THERMAL PRINTERS AND METHOD OF INSTALLATION

CROSS-REFERENCE TO RELATED APPLICATION

This application claims priority pursuant to 35 U.S.C. 119 (e) to U.S. Provisional Application No. 61/045,489, filed on Apr. 16, 2008 which is incorporated herein by reference in its entirety.

FIELD OF THE INVENTION

The present invention relates to a ribbon guide, and more particularly, to a ribbon guide for installing thermal ribbon in thermal printers and a method for such installation.

BACKGROUND OF THE INVENTION

A thermal printer may be defined as a printer that prints on paper or synthetic material by selectively melting selected portions of an ink coated ribbon so that the ink is adhered to the material on which it is applied. Thermal printers generally use a fixed width thermal print head, pressing onto the material to be printed as the material passes over a driven rubber roller, called a platen roller. The layered ribbon, also known as thermal transfer ribbon is sandwiched between the print head, the material to be printed, and the platen roller. A typical thermal ribbon is a very thin film, on the order of about one mil, and is comprised of several layers including a resin and/or wax layer containing a transfer ink, a release layer over the resin/wax layer, a carrier layer over the release layer, and a back coat over the carrier layer to provide a low-friction surface for engaging the print head. The thermal ribbon is spooled onto a reel and the thermal ribbon is driven through the printer synchronized with the material to be printed. As the material to be printed and the thermal ribbon are driven beneath the print head, tiny pixels across the width of the print head are heated to melt the ink off the thermal ribbon and onto the material to be printed.

Thermal printers are very useful when the life of the printed material is long or the printed material needs to survive in a harsh environment. Examples of thermal printer devices are shown and described in U.S. Pat. No. 5,372,439 (hereafter "'439") issued in 1994 to Poole et al., for a "Thermal Transfer Printer With Controlled Ribbon Feed"; U.S. Pat. No. 5,537,135 issued in 1996 to Hevenor et al., for a "Method And Apparatus For Making A Graphic Product"; and U.S. Pat. No. 6,057,870 (hereafter "'870") issued in 2000 to Monnier et al., for a "Ribbon Drive System For A Thermal Demand Printer."

In regard to the thermal printers disclosed in the '439 and '870 patents, the loading or installing of the thin film thermal ribbon through the thermal printers is difficult and somewhat dangerous. No specialized apparatus is known to exist for the purpose of helping an operator install a fresh thermal ribbon supply.

SUMMARY OF THE INVENTION

In accordance with the present invention, an advantageous apparatus is provided that helps an operator install or load a new thermal ribbon supply. The present invention also provides an advantageous method for the installation of the thermal ribbon. A described preferred embodiment of a ribbon guide is set forth below and includes a simple and inexpensive solution to the installation problem. The ribbon guide reduces ribbon handling by an operator, and thus his/her hands are cleaner and likely to smell much less than would be the case if the thermal ribbon was handled during the entire installation process. Use of the ribbon guide also keeps the hands of an operator away from moving and/or hot parts of the thermal printer and is therefore a safety feature. In addition, forming the ribbon guide of a specific material to be described below also reduces the amount of dust, oil, and dirt entering the interior of the thermal printer. An added advantage is that the ribbon guide may be used as an advertising platform and/or as a helpful tool.

Briefly summarized, the invention includes a ribbon guide for a thermal ribbon used in a thermal printer, the ribbon guide having a first portion to enable connection with the thermal ribbon, and another portion integral with the first portion having a surface for printing thereon. The invention also relates to a method for using the ribbon guide to install the thermal ribbon in the thermal printer, the method including the steps of placing an end of a supply of thermal ribbon into an opening in the ribbon guide to have the ribbon guide engage and restrain the thermal ribbon, gripping the ribbon guide, and moving the ribbon guide passed internal mechanisms and a print head of the thermal printer.

BRIEF DESCRIPTION OF THE DRAWINGS

For the purpose of facilitating an understanding of the invention, the accompanying drawings and description illustrate a preferred embodiment thereof, from which the invention, its structures, its construction and operation, its processes, and many related advantages may be readily understood and appreciated.

DESCRIPTION OF THE PREFERRED EMBODIMENTS

The following description is provided to enable those skilled in the art to make and use the described embodiment set forth in the best mode contemplated for carrying out the invention. Various modifications, equivalents, variations, and alternatives, however, will be readily apparent to those skilled in the art. Any and all such modifications, variations, equivalents, and alternatives are intended to fall within the spirit and scope of the present invention.

Figure 1:
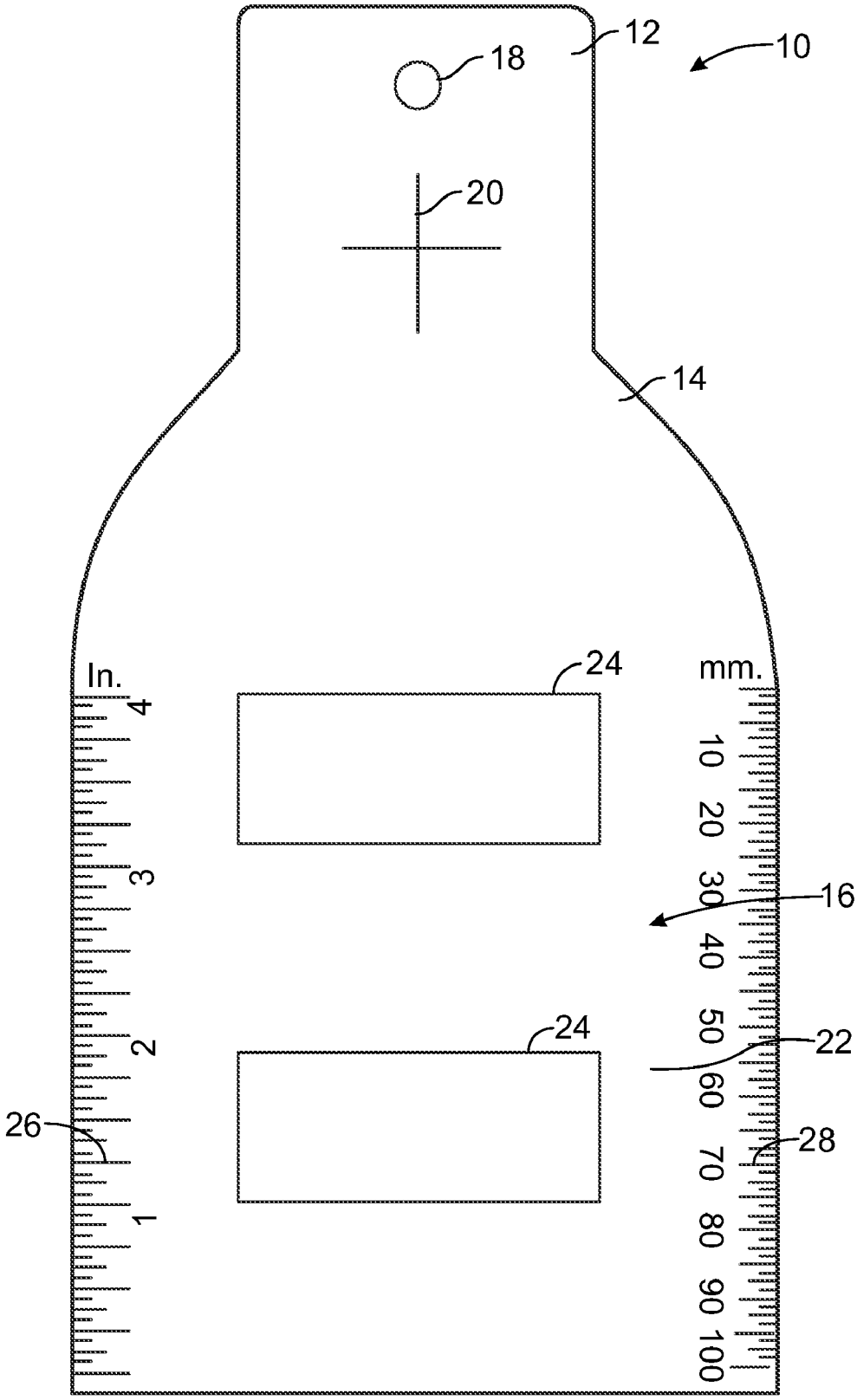
FIG. 1 is a top plan view of a preferred embodiment of a ribbon guide.

Referring to FIG. 1, a preferred embodiment of a ribbon guide 10 is illustrated. The ribbon guide is a sheet having a generally bottle shape profile with a first or connector portion 12, a second or transition portion 14 and a third or lead portion 16. The first portion 12 of the ribbon guide 10 includes a hole 18 and a slit 20 configured in a cross. The first portion 12 is smaller in width than the third portion 16, and with the transition portion 14 located between the first and third portions, the ribbon guide assumes the bottle-like profile. The third portion 16 of the ribbon guide has two surfaces (of which only one surface 22 is shown) suitable for printing. Printing examples shown in FIG. 1, include advertising 24 in the center of the surface 22 and useful information for an operator, such as scales, at lateral edge sections 26, 28. The scale of the left edge section 26 is in units of inches and the scale of the right edge section 28 is in metric units, in particular millimeters.

A preferred width for the first portion 12 of the ribbon guide 10 is about two inches, and for the third portion 16, a preferred width is about four inches. A preferred length for the ribbon guide is about eight inches of which about one-quarter of the length is devoted to the first portion 12, about one-quarter to the second portion 14, and about two-quarters to the third portion 16. In the alternative, the ribbon guide may be formed in other shapes, for example, a rectangle, a square, an oval, or even a figure eight configuration. Alternatively, other dimensions for the ribbon guide may be used and other kinds of printing may appear on the ribbon guide surfaces as desired. Dimensions for the ribbon guide may be a function of the size of the thermal printer.

A preferred material for the ribbon guide 10 is V-Max® brand synthetic paper that is available from Valeron Strength Films, a business unit of Illinois Tool Works Inc., with a location in Houston, Tex. V-Max® brand synthetic paper is a multi-layer product comprised of thin individual layers of high density polyethylene that have been extruded, stretched, bias-cut and cross laminated into a composite structure comprised of three to fifteen total layers. This process results in a unique polyolefin sheet that is extremely tough, tear resistant and completely waterproof. Unaffected by most chemicals, it has a wide service temperature range and is formulated to provide extended outdoor performance, in part because it is UV-stabilized. V-Max® brand synthetic paper is non-toxic, odorless and can be recycled or incinerated. Optional clay coatings may be added to the surfaces of the ribbon guide and are designed to enhance smoothness and provide superior printability.

It is preferred that the thickness of the ribbon guide 10 is approximately twenty mils. A ribbon guide of V-Max® brand synthetic paper of about twenty mils thickness will be generally self supporting, but bendable and flexible, so as to allow the ribbon guide to be manipulated and pushed or guided through the internal mechanisms of a thermal printer as will be explained below in more detail. A ribbon guide formed of V-Max® brand synthetic paper is very durable and will have a long usage life. The material is also readily available and relatively inexpensive. Alternatively, other films and synthetic papers may be used for forming the ribbon guide, if desired. Also, decorative designs may be printed on the ribbon guide instead of, or in addition to, the advertising.

Figure 2:
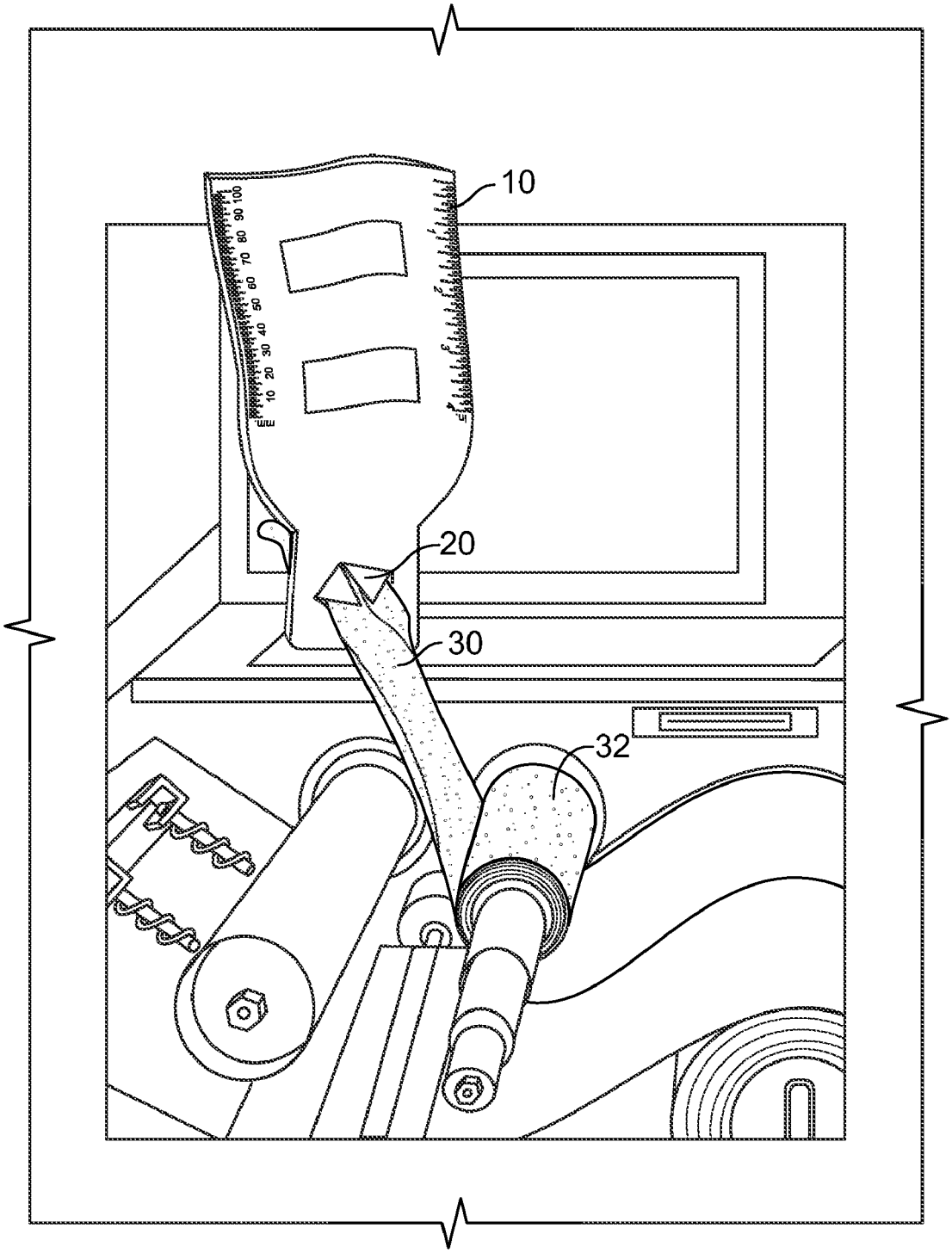
FIG. 2 is an isometric view of the ribbon guide shown in FIG. 1, connected to an end portion of a thin film thermal ribbon.

Referring now to FIG. 2, the ribbon guide 10 is shown with an end portion 30 of a thermal ribbon 32 received by the opening created by the cross-shaped slit 20. The thermal ribbon is generally quite thin, about one mil, and is easily squeezed and stuffed into the opening of the slit to connect the thermal ribbon to the ribbon guide and restrain the ribbon in place during installation of the ribbon in a thermal printer. It should be understood that when force is applied to the cross-shaped slit 20, the slit opens. When the force is removed the slit generally closes, at least partially.

As can now be appreciated, the very thin thermal ribbon 32, by itself, is difficult to handle and push through a thermal printer because the thermal ribbon is flimsy and non self-supporting. Any force placed against the end portion 30 of the thermal ribbon 32 will immediately collapse or compress the thermal ribbon. By contrast, the ribbon guide 10, being self-supporting, resists the usual forces expected in a loading operation and may bend, but the ribbon guide will not collapse during an installation process the way the thermal ribbon will collapse. The engagement between the thermal ribbon 32 and the ribbon guide material around the cross-shaped slit 20 provides enough interference and friction to maintain the thermal ribbon in contact with the ribbon guide during the installation process.

The hole 18 in the first portion 12 of the ribbon guide 10 is formed for convenience of an operator who may hang the ribbon guide from a peg or a nail (not shown) when the ribbon guide is not being used. In the alternative, the ribbon guide may be rested on a counter top and the hole may not be necessary.

Figure 3:
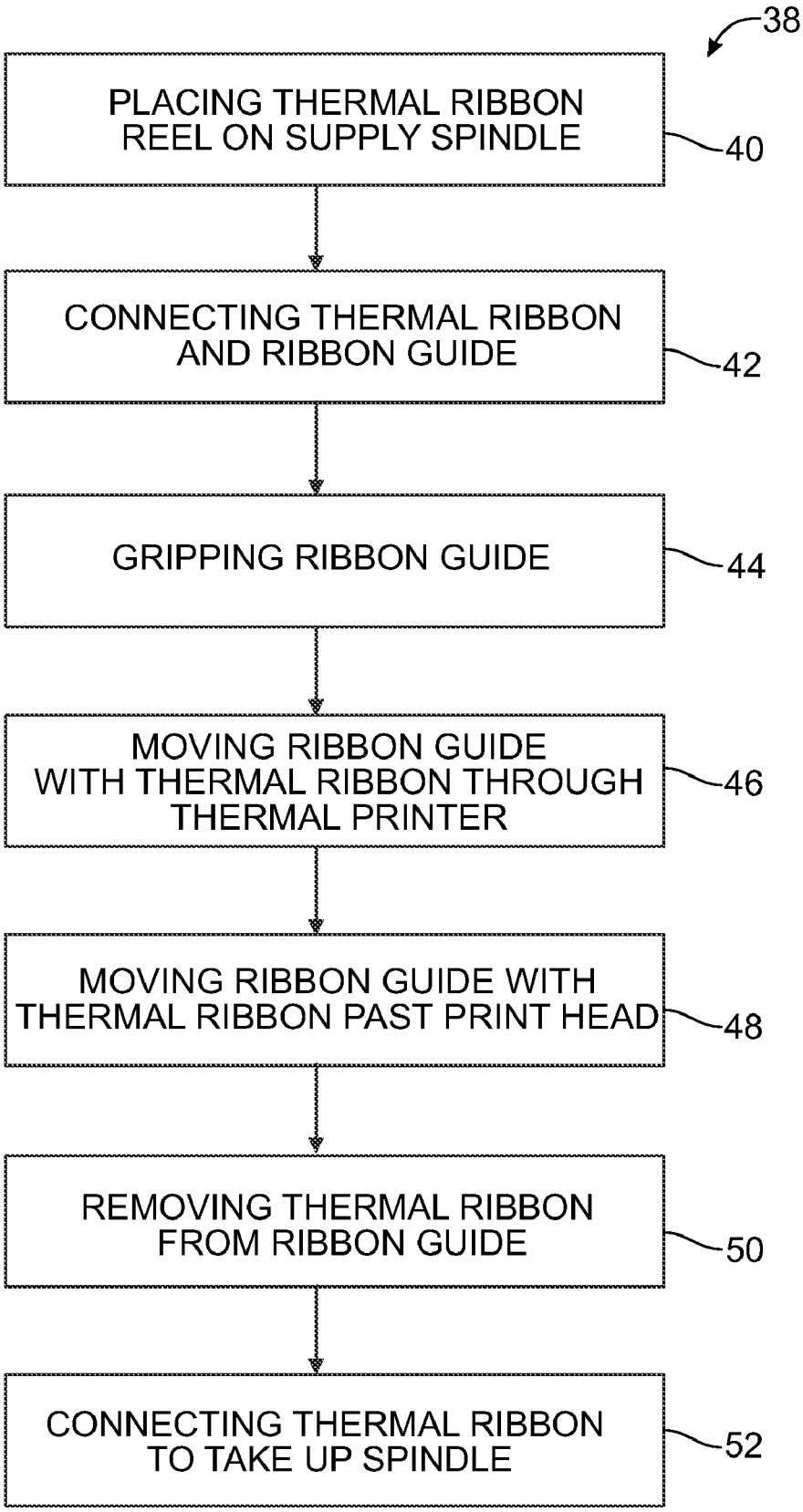
FIG. 3 is a flow diagram of a method for installing the thermal ribbon in a thermal printer.

Turning now to FIG. 3, a method 38 that may be used by an operator to install or load a thermal ribbon 30 in a thermal printer may include the steps of placing or spooling a thermal ribbon on a supply reel and mounting the reel on a supply spindle 40, connecting an end portion 30 of the thermal ribbon 32 from the supply reel into an opening created by the cross-shaped slit 20 in the ribbon guide 10 to engage and restrain the thermal ribbon 42, followed by an operator gripping the ribbon guide 44 about the second portion 14, moving the ribbon guide through the internal mechanisms of the thermal printer 46, moving the ribbon guide with the thermal ribbon attached passed a print head 48, removing the thermal ribbon from the ribbon guide 50, and connecting the thermal ribbon to a take-up spindle 52. As mentioned above, it is difficult to move the thermal ribbon by itself through a thermal printer because the thin film thermal ribbon is so flimsy. Pushing on the thermal ribbon causes it to collapse or compress. Installation is still possible, with practice, but nevertheless, it remains difficult. Using the ribbon guide eliminates the problem of collapse because the ribbon guide is self-supporting and thus much easier to handle. It should be noted that an operator may, as an alternative, grip the ribbon guide in a location other than the second portion 14 if he/she finds it more comfortable, and the ribbon guide may be oriented with the lead portion 16 facing downstream in the thermal printer, or the connection portion 12 may go through the internal mechanisms of the thermal printer first.

Using the ribbon guide 10 also reduces ribbon handling by an operator, and thus, his/her hands are cleaner and more likely to be free of any smell, or any smell may be greatly reduced. Use of a ribbon guide also keeps the hands of an operator away from moving and/or hot parts of the thermal printer and is therefore, an advantageous safety feature. In addition, by forming the ribbon guide of V-Max® brand synthetic paper the amount of dust, oil, and dirt entering the interior of the thermal printer is reduced because dust, oil, dirt and the like, do not easily adhere to a clay coated ribbon guide of V-Max® brand synthetic paper. And as an added bonus, the ribbon guide 10 may be used as an advertising platform and as a helpful tool. V-Max® brand synthetic paper is easily printable and is inexpensive enough to allow ribbon guides to be given away as promotional advertising by a thermal printer producer/seller or a media supplier, as examples.

Figure 4:
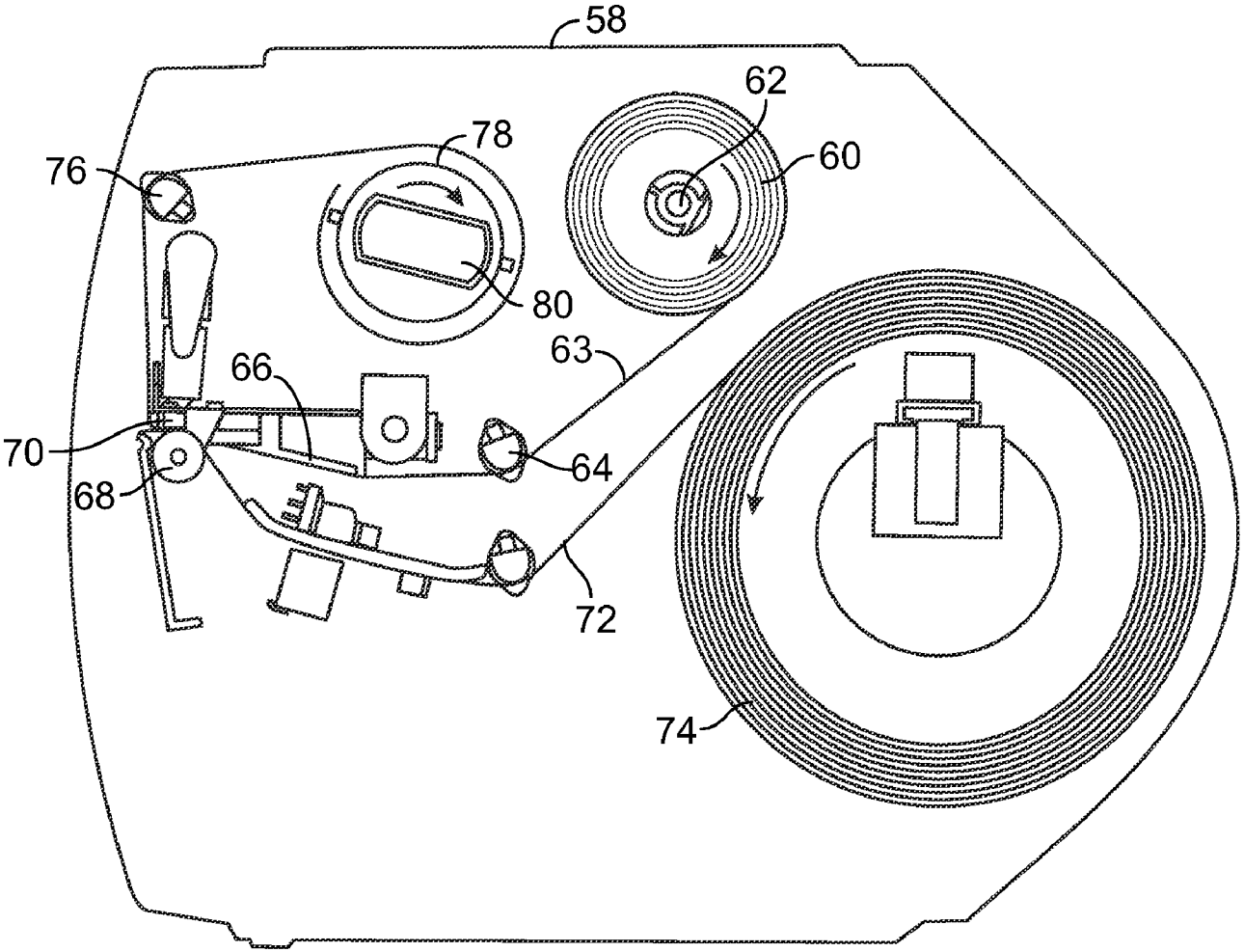
FIG. 4 is a diagrammatic view of a path taken by the ribbon guide and the thermal ribbon through a thermal printer.

Shown diagrammatically in FIG. 4, is an elevation view of what is intended to be a generic thermal printer 58 and is illustrated to provide a general understanding of the path taken by a thermal ribbon in a thermal printer. It should be understood that each brand of thermal printer is designed and structured somewhat differently, however as explained above, all operate on the same basic principles.

In operation, a fresh reel of thermal ribbon 60 is loaded onto a spindle or shaft 62, after which an end portion of the thermal ribbon is connected and engaged with the ribbon guide 10 as shown in FIG. 2. The ribbon guide is gripped by an operator and moved downwardly, pulling the thermal ribbon 63 around a first roller 64, along a guide plate 66 to a platen roller 68 under a print head assembly 70. At this location, material to be printed 72, often called a substrate or media, from a supply roll 74 moves over the platen roller 68 and under the thermal ribbon 63. When printing occurs, the print head melts selective portions of "ink" material off of the thermal ribbon and deposits the ink unto to the media. It is noted that the media or material to be printed may be paper or film and, in particular, may be V-Max® brand synthetic paper, the same material used to form the ribbon guide.

Downstream (that is, following movement of the thermal ribbon 63 and the media 72 in the view of FIG. 4) of the platen roller 68, the ribbon guide is moved upwardly and around another roller 76 before the thermal ribbon is detached from the ribbon guide and attached to a take-up reel 78 rotating on a take-up spindle 80. Alternately, the location of the various parts of the internal mechanisms of the thermal printer may be varied or there may be more or less rollers and different paths for the thermal ribbon and the media without affecting the invention of the ribbon guide described above.

From the foregoing, it can be seen that there has been provided features for a ribbon guide for thermal ribbons of the type used in thermal printers and for a method of using the ribbon guide. While a particular embodiment of the present invention has been shown and described in detail, it will be obvious to those skilled in the art that changes and modifications may be made without departing from the invention in its broader aspects. Therefore, the aim here is to cover all such changes and modifications as fall within the true spirit and scope of the invention as expressed in the appended claims. The matters set forth in the foregoing description and accompanying drawings are offered by way of illustrations only and not as claim limitations. The actual scope of the invention is to be defined by the subsequent claims when viewed in their proper perspective based on the prior art.

What is claimed is:

1. A ribbon guide apparatus used in a thermal printer comprising:

a first portion to enable connection with a thermal ribbon, said first portion including an opening for receiving the thermal ribbon, for engaging the thermal ribbon, and for restraining the thermal ribbon;

a second portion integral with the first portion; and a third portion integral with the first and the second portions having a surface for printing thereon wherein said first, second and third portions of the ribbon guide apparatus are formed of a bendable and self-supporting material.

2. The apparatus of claim 1, comprising:

a grip comprising said second portion with said third portion comprising a lead portion of the ribbon guide apparatus.

3. The apparatus of claim 1, comprising:

a grip oriented with said first portion comprising a lead portion of the ribbon guide apparatus.

4. The apparatus of claim 3, wherein:

said grip comprises said second portion with said first portion being the lead portion of the ribbon guide apparatus facilitating the operator to grip the ribbon guide apparatus at said second portion.

5. The apparatus of claim 3, wherein:

said grip comprises said third portion with said first portion being the lead portion of the ribbon guide apparatus facilitating the operator to grip the ribbon guide apparatus at said third portion.

6. The apparatus of claim 1, wherein:

the opening is a slit in the ribbon guide.

7. The apparatus of claim 6, wherein:

the slit has a cross shape.

8. The apparatus of claim 1, wherein:

advertising is printed on the surface of the third portion.

9. The apparatus of claim 1, wherein:

a scale is printed on the surface of the third portion.

* * * * *